US010994910B2

(12) United States Patent
Unruh et al.

(10) Patent No.: US 10,994,910 B2
(45) Date of Patent: May 4, 2021

(54) PACKAGE OF INSULATING PRODUCTS AND PROCESS FOR MANUFACTURING SUCH A PACKAGE

(71) Applicant: SAINT-GOBAIN ISOVER, Courbevoie (FR)

(72) Inventors: Andreas Unruh, Neustadt (DE); Vincent Patriti, Houilles (FR)

(73) Assignee: SAINT-GOBAIN ISOVER, Courbevoie (FR)

( * ) Notice: Subject to any disclaimer, the term of this patent is extended or adjusted under 35 U.S.C. 154(b) by 206 days.

(21) Appl. No.: 16/325,214

(22) PCT Filed: Aug. 29, 2017

(86) PCT No.: PCT/FR2017/052297
§ 371 (c)(1),
(2) Date: Feb. 13, 2019

(87) PCT Pub. No.: WO2018/042119
PCT Pub. Date: Mar. 8, 2018

(65) Prior Publication Data

US 2019/0202614 A1 Jul. 4, 2019

(30) Foreign Application Priority Data

Aug. 30, 2016 (FR) ..... 1658048

(51) Int. Cl.
*B65D 85/07* (2017.01)
*B65D 71/00* (2006.01)
*B65B 11/58* (2006.01)

(52) U.S. Cl.
CPC ..... *B65D 71/0096* (2013.01); *B65B 11/585* (2013.01); *B65D 85/07* (2018.01); *B65B 2220/16* (2013.01); *B65D 2571/00018* (2013.01)

(58) Field of Classification Search
CPC ..... B65D 71/0096; B65D 71/0092; B65D 71/0088; B65D 19/00; B65D 85/07; B65D 2571/0018
(Continued)

(56) References Cited

U.S. PATENT DOCUMENTS 7,311,199 B2 * 12/2007 Vantilt ..... B65D 75/38 206/321
2006/0196799 A1 9/2006 Vantilt
(Continued)

FOREIGN PATENT DOCUMENTS

EP 0 050 078 A1 4/1982
EP 0 220 980 A1 5/1987
(Continued)

OTHER PUBLICATIONS

International Search Report dated Oct. 17, 2017 in PCT/FR2017/052297 filed Aug. 29, 2017.

*Primary Examiner* — King M Chu
(74) *Attorney, Agent, or Firm* — Oblon, McClelland, Maier & Neustadt, L.L.P.

(57) ABSTRACT

A pack includes compressible insulation products that each have a longitudinal axis, a peripheral surface, and first and second ends. The pack includes a stack of at least two modules, where each module includes a row of insulation products positioned next to one another along a first direction. The modules of the stack are superimposed along a second direction perpendicular to the longitudinal axes of the insulation products and to the first direction. The pack also includes a cover that wraps the stack by covering five faces of the stack including the two end faces of the stack formed by the ends of the insulation products and at least the periphery of the sixth face of the stack.

18 Claims, 6 Drawing Sheets

(58) Field of Classification Search
USPC ..... 206/386
See application file for complete search history.

(56) References Cited

U.S. PATENT DOCUMENTS

| | | | | |
|---|---|---|---|---|
| 2012/0205272 | A1* | 8/2012 | Heilman | B65D 75/38<br>206/386 |
| 2013/0067861 | A1* | 3/2013 | Turner | B65D 75/006<br>53/428 |

FOREIGN PATENT DOCUMENTS

| | | | |
|---|---|---|---|
| EP | 1 777 170 | A1 | 4/2007 |
| WO | WO 2004/103821 | A1 | 12/2004 |

* cited by examiner

PACKAGE OF INSULATING PRODUCTS AND PROCESS FOR MANUFACTURING SUCH A PACKAGE

BACKGROUND

The present invention relates to the packaging of compressible insulation products, in particular with a view to the transport thereof or the storage thereof. More specifically, the invention relates to a pack comprising compressible insulation products that are, in unit form, in the form of rolls or of substantially parallel batches of boards. The invention also relates to a process for manufacturing such a pack, and to a palletized assembly comprising such packs.

Fibrous insulation products, such as felts made of glass wool or other mineral wool, are low-density products that occupy a large volume. In order to facilitate the transport thereof and the storage thereof, it is desirable to limit the bulkiness of these products and to produce palletizable loads. For this purpose, the insulation products in unit form are conventionally packaged in a compressed state, by being covered with a protective wrapper generally made of kraft paper or plastic, the insulation products then being assembled in the form of rows and then positioned on pallets.

One constraint for the packaging is that the deformations generated during a compression of the insulation product must not degrade its ability to recover its thickness upon being unwrapped, the insulating qualities of the product being dependent on this thickness recovery. Another constraint is the need to protect the insulation product with respect to the external environment, in particular when it comprises a binder that is sensitive to the effects of moisture. However, the protective wrapper that makes it possible to keep the product in the form of a roll, or to assemble a series of boards as one batch, does not generally cover the whole of the outer surface of the product and is therefore not sufficient to ensure complete protection against moisture.

EP 0 220 980 A1 describes a package in which a module is formed by juxtaposing several insulation products in a row, and encircling the row using a film sealed upon itself. Several modules are then superimposed on a pallet and everything is assembled by stretch-wrapping. One drawback of this type of package is that, even though the rolls or the batches of boards are protected by the stretch-wrapping film, they are however no longer protected, in particular at their ends, once the palletized assembly has been opened or damaged. There is then a risk of infiltration of water into the insulation product, which may lead to a degradation of its insulating properties.

BRIEF SUMMARY

It is these drawbacks that the invention intends, more particularly, to solve by proposing a pack of compressible insulation products that makes it possible to preserve the quality of the insulation products, in particular in terms of thickness recovery.

For this purpose, one subject of the invention is a pack of compressible insulation products, each insulation product having a longitudinal axis, a peripheral surface and first and second ends, the pack comprising a stack of at least two superimposed modules, where each module comprises:

a row of insulation products positioned next to one another, successively along a first direction perpendicular to the longitudinal axes of the insulation products, the insulation products of the row having their longitudinal axes parallel to one another, a first film which wraps each insulation product of the row in a compressed state of the insulation product, by covering the peripheral surface of the insulation product, a second film which wraps the row of insulation products, by covering some of the peripheral surface of the insulation products of the row, the modules of the stack being superimposed along a second direction perpendicular to the longitudinal axes of the insulation products and to the first direction of each module, the stack comprising two end faces formed by the ends of the insulation products and main faces and transverse faces that are perpendicular to the end faces, characterized in that the pack comprises a cover which wraps the stack of superimposed modules, by covering five faces of the stack including the two end faces and at least the periphery of the sixth face of the stack.

According to one feature, each module of a pack according to the invention comprises a single row of insulation products positioned next to one another, successively along the first direction perpendicular to the longitudinal axes of the insulation products, the insulation products of the single row having their longitudinal axes parallel to one another. The second film then wraps the single row of insulation products by covering some of the peripheral surface of the insulation products of the row.

Throughout this patent application, the term "cover", when it is used alone, should by default be understood as denoting a cover that wraps a stack of modules. When reference is made to a cover of a palletized assembly, which is different from a cover that wraps a stack of modules, it is systematically specified that it is an "outer cover".

Within the context of the invention, the insulation products may be rolls. As a variant, the insulation products may be batches of several boards that have been preassembled, for example by means of a heat-shrinkable film, these batches having a substantially parallelepipedal shape and having a similar bulkiness to that of the rolls. In what follows, reference is often made to rolls, it being understood that the invention is not limited to this particular case.

Within the context of the invention, the stack of modules, which corresponds to one tier of modules in a palletized assembly, is completely covered by the combination of the second film and the cover. Thus, by means of the invention, packs of insulation products, intended to form all or part of a tier in a palletized assembly, are obtained that are watertight. The stack of modules is enclosed within a package, formed by the combination of the second film and the cover, which covers all of the faces of the stack of modules.

The invention makes it possible to produce palletized assemblies of rolls or of boards very simply, by superimposing several packs in accordance with the invention each corresponding to one tier of the palletized load, while guaranteeing that the insulation products in each pack are protected from moisture or other external contaminants even in the event of opening or damaging the outer protection of the palletized assembly, which may be a stretch-wrapping film or a stretchable or shrinkable cover. This is particularly advantageous when the insulation products comprise a binder that is sensitive to moisture, such as a bio-based binder, in particular based on saccharides, sugars and/or sugar alcohols. Such palletized assemblies may be stored outside, without further precautions, without risk of deterioration of the quality of the insulation products and in particular without any thickness recovery problems. Advantageously, it is possible to subdivide the palletized loads obtained according to the invention into a series of watertight packs, which is practical, in particular during unpacking operations.

According to one feature of the invention, the second film forms, around the row of insulation products, a sleeve having an axis parallel to the longitudinal axes of the insulation products. More specifically, the row of insulation products comprises two main faces and two transverse faces perpendicular to the ends of the insulation products, and the second film wraps the row of insulation products by extending over the main faces and the transverse faces of the row.

According to one advantageous feature, the second film wraps the row of insulation products in a compressed state of the insulation products against one another along the first direction. This compression along the first direction, which is in addition to the compression of each insulation product provided by the first film, helps to limit the bulkiness of the packs of insulation products in accordance with the invention.

According to one advantageous aspect, the first film and the second film are plastic films that have relatively weak extension properties. In particular, each of the first film and the second film preferably has a strength at 10% elongation of greater than 15 MPa, preferably of greater than 17 MPa or 20 MPa, in the extrusion direction and in the direction transverse to the extrusion direction. The strength may be measured according to the standard ISO 527/3, on standardized film test specimens. According to this standard, the elongation of the film is measured for an increasing tensile force applied to the film (measured in MPa) and a standardized speed. The compression of each insulation product and the compression of each row of insulation products may thus be obtained and maintained, respectively, by a single first film and by a single second film. Preferably, the first film and the second film are made of high-density polyethylene (HDPE).

According to one feature of the invention, the cover has a main axis of deployment that is perpendicular to the longitudinal axes of the insulation products.

Preferably, the cover wraps the stack of superimposed modules by covering five faces of the stack, including the two end faces, and by covering only a peripheral portion of the sixth face of the stack. In other words, the cover then has an opening on the sixth face of the stack.

In one advantageous embodiment, the cover comprises an opening on a main face of the stack perpendicular to the second direction. This is the preferred arrangement when the cover comprises an opening, since the edge of the cover delimiting the opening is then located on the periphery of a face of the stack where the second film of one of the end modules of the stack creates a flat and continuous surface, which guarantees a continuous overlap between the cover and the second film. Preferably, in this embodiment, the edge of the cover and the second film which are present on this main face of the stack are not joined together, which makes the process for manufacturing the pack in accordance with the invention particularly simple, rapid and economical, while having high protection in particular against infiltration of water inside the pack owing to the continuous overlap of the cover and the second film. According to one variant, the edge of the cover and the second film present on this main face of the stack may be joined together, for example by adhesive bonding or by welding.

In one less preferred embodiment, when the cover comprises an opening, the opening of the cover may be located on a transverse face of the stack perpendicular to the first direction. This is the only other option possible when the cover comprises an opening, since within the context of the invention the cover necessarily covers the two end faces of the stack. This arrangement is less advantageous than the previous one, since the edge of the cover delimiting the opening is then located on the periphery of a face of the stack which is formed by curved peripheral sides of the various modules of the stack which are covered by several different second films, which does not guarantee a continuous overlap between the cover and the second films. It is then more difficult to make the pack watertight.

In another embodiment, the cover has no opening and covers the six faces of the stack. In this embodiment, the cover may be installed on the stack of modules in a covering device that makes it possible, after the cover has been deployed around the stack, to seal the material of the cover to itself, in particular by welding, opposite the sixth face of the stack.

Preferably, the cover is a stretchable cover, formed from a sheath of stretchable plastic film, for example made of low-density polyethylene (LDPE). The use of a stretchable film sheath makes it possible to ensure a good stability and a good watertightness of the pack of insulation products. Advantageously, unlike a film, the insulation of a stretchable sheath does not require a heat source, since it is sufficient to mechanically prestretch the material of the plastic film in the transverse direction before wrapping the stack of modules. After the stretched cover has been placed over the stack of modules, the tightening of the material of the stretchable film takes place naturally by elasticity, which firmly holds the cover around the stack of modules.

According to one variant, in one less preferred embodiment, the cover may be a shrinkable cover, formed from a sheath of heat-shrinkable plastic film, for example made of heat-shrinkable polyethylene.

According to one aspect of the invention, the second film is a plastic film having a higher tensile strength than that of the constituent plastic film of the cover. By way of example, the second film may be made of high-density polyethylene (HDPE), whilst the constituent plastic film of the cover is made of low-density polyethylene (LDPE).

Within the context of the invention, each row advantageously comprises a number of insulation products of between 2 and 10.

Another subject of the invention is a palletized assembly comprising a pallet, at least two packs of compressible insulation products as described above that are superimposed on one another and on the pallet with the longitudinal axes of the insulation products perpendicular to the pallet, and means for holding packs on the pallet.

In one embodiment, the means for holding packs on the pallet comprise an outer cover. According to one preferred variant, the outer cover is a stretchable cover, formed by stretching, at the periphery of the packs, a sheath of stretchable plastic film, for example a sheath made of low-density polyethylene (LDPE). According to one less preferred variant, the outer cover is a shrinkable cover, formed by shrinking, at the periphery of the packs, a sheath of heat-shrinkable plastic film, for example a sheath made of heat-shrinkable polyethylene.

In another embodiment, the means for holding packs on the pallet comprise a stretch-wrapped film at the periphery of the packs, for example a polyethylene film with a thickness of 20 to 30 microns having a mechanical stretchability of greater than 200%, in particular of the order of 250%. Conventionally, a top sheet is also provided on the top of the load formed by the packs, for example made of a relatively thick polyethylene film, having a thickness of at least 75 microns.

Another subject of the invention is a process for manufacturing a pack comprising compressible insulation products, each insulation product having a longitudinal axis, a peripheral surface and first and second ends, the process comprising steps wherein:

each insulation product is wrapped using a first film that covers the peripheral surface of the insulation product and which maintains the insulation product in a compressed state;

a row of insulation products is formed by positioning several insulation products provided with the first film next to one another, successively along a first direction perpendicular to the longitudinal axes of the insulation products, the insulation products of the row having their longitudinal axes parallel to one another;

a module is formed by wrapping the row of insulation products using a second film, which covers some of the peripheral surface of the insulation products of the row and which holds the insulation products of the row next to one another along the first direction;

a stack of modules is formed by superimposing at least two modules along a direction perpendicular to the longitudinal axes of the insulation products and to the first direction of each module;

the pack is formed by wrapping the stack of modules using a cover which covers at least five faces of the stack including the two end faces of the stack formed by the ends of the insulation products.

Another subject of the invention is a process for manufacturing a palletized assembly comprising compressible insulation products, each insulation product having a longitudinal axis, a peripheral surface and first and second ends, the process comprising steps wherein:

each insulation product is wrapped using a first film that covers the peripheral surface of the insulation product and which maintains the insulation product in a compressed state;

a row of insulation products is formed by positioning several insulation products provided with the first film next to one another, successively along a first direction perpendicular to the longitudinal axes of the insulation products, the insulation products of the row having their longitudinal axes parallel to one another;

a module is formed by wrapping the row of insulation products using a second film, which covers some of the peripheral surface of the insulation products of the row and which holds the insulation products of the row next to one another along the first direction;

a stack of modules is formed by superimposing at least two modules along a direction perpendicular to the longitudinal axes of the insulation products and to the first direction of each module;

a pack is formed by wrapping the stack of modules using a cover which covers at least five faces of the stack including the two end faces of the stack formed by the ends of the insulation products;

at least two packs are superimposed on one another and on a pallet with the longitudinal axes of the insulation products perpendicular to the pallet;

the packs and the pallet are assembled using means for holding the packs on the pallet.

Within the context of a process according to the invention, the row of insulation products may be formed in a stacker. Furthermore, the wrapping of the row of insulation products using the second film may be carried out by encircling so as to form a sleeve having an axis parallel to the longitudinal axes of the insulation products, the second film being deployed around the row along the first direction. For encircling the row of insulation products using the second film, the encircling device advantageously comprises means for the relative displacement of a band of film around the row of insulation products.

Furthermore, within the context of the process according to the invention, the wrapping of the stack of modules using the cover is advantageously carried out by stretching a sheath of stretchable plastic film, for example made of low-density polyethylene (LDPE), the sheath being deployed around the stack along a direction perpendicular to the longitudinal axes of the insulation products. As a variant, in one less preferred embodiment, the wrapping of the stack of modules using the cover may be carried out by shrinking a sheath of heat-shrinkable plastic film.

In one embodiment of the invention, the packs and the pallet are assembled using an outer cover obtained by stretching or shrinking a sheath of plastic film, the sheath being deployed around the packs and the pallet along a direction parallel to the longitudinal axes of the insulation products.

In another embodiment of the invention, the packs and the pallet are assembled by stretch wrapping, using a stretch-wrapping film which is deployed around the packs and the pallet along a stretch-wrapping direction parallel to the longitudinal axes of the insulation products.

BRIEF DESCRIPTION OF THE DRAWINGS

The features and advantages of the invention will become apparent in the following description of embodiments of a pack of insulation products and of a palletized assembly in accordance with the invention, given solely by way of example and with reference to the appended drawings, in which.

DETAILED DESCRIPTION

Figure 1:
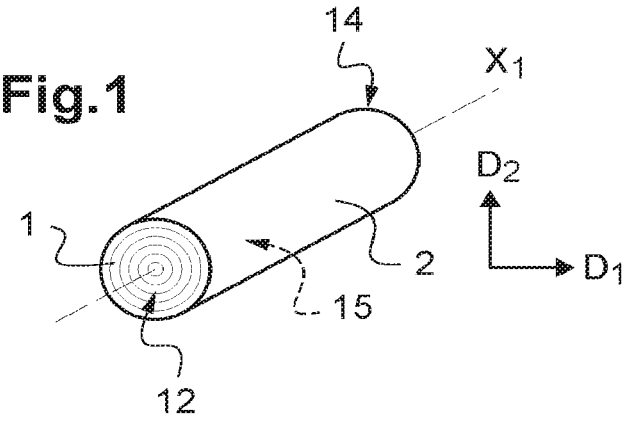
FIGS. 1 to 5 are schematic perspective views showing successive steps of a process for manufacturing a pack of rolls in accordance with the invention.

Schematically illustrated in FIG. 1 is a roll 1, formed by rolling up a strip of insulation made of compressible fibrous material, such as glass wool or rock wool. This roll has a longitudinal axis $X_1$, a peripheral surface 15 and two ends 12 and 14. Conventionally, during the rolling up of the roll 1, the fibrous material undergoes a compression, with a compression ratio suitable for ensuring both that the bulkiness of the strip of insulation is minimized in the rolled-up state and that the strip of insulation regains its thickness and its insulating characteristics in the rolled out state. The roll 1 has also been wrapped with a first film 2 that maintains the roll in a compressed state, by covering the peripheral surface 15 of the roll. By way of example, the roll 1 has a diameter at its ends 12, 14 of the order of 300 to 600 mm, and each roll has a length parallel to the axis $X_1$ of the order of 800 to 1250 mm.

Figure 2:
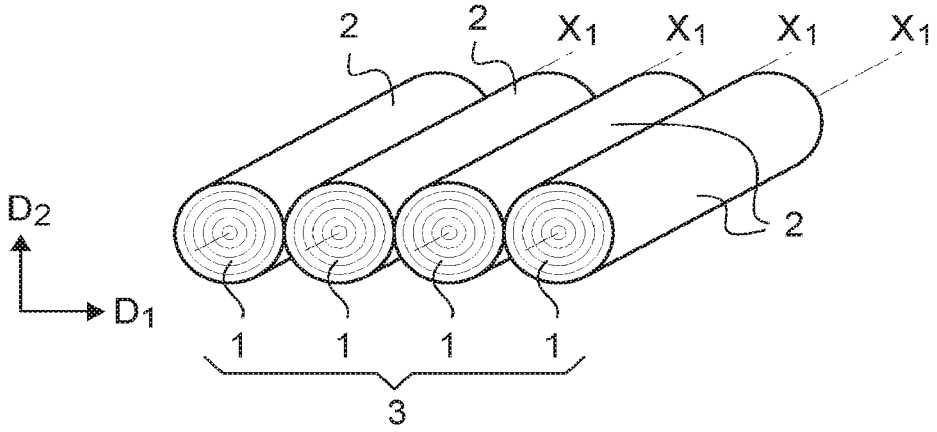

As shown in FIG. 2, a row 3 of rolls is formed by positioning several rolls 1 next to one another, successively along a first direction $D_1$ perpendicular to the longitudinal axes $X_1$ of the rolls, with their axes $X_1$ parallel to one another. By way of example, the row 3 has a length along the first direction $D_1$ of the order of 900 to 3000 mm, which corresponds to a row of three to six rolls depending on the diameter of the rolls. In the example represented, each row 3 comprises four juxtaposed rolls 1 and has a length along the first direction $D_1$ of the order of 1600 mm.

Figure 3:
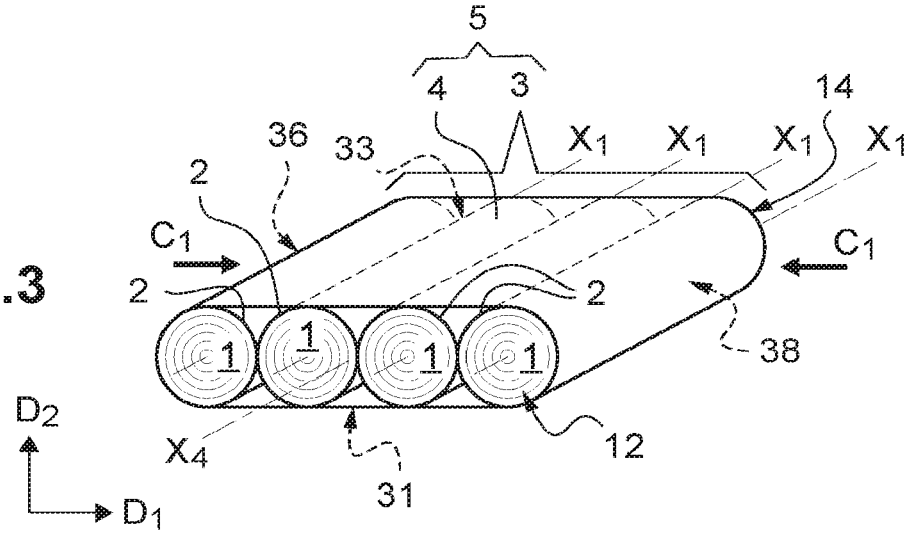

In order to form a module 5, which has a single row 3 of rolls 1, the row 3 is wrapped with a second film 4, with application of a compression of the rolls 1 of the row against one another along the direction of the arrows $C_1$ in FIG. 3, which corresponds to the first direction $D_1$, the compression being maintained by the wrapping with the second film 4. The wrapping with the second film 4 may be carried out in an encircling device, for example in which the film 4 is deployed around the row 3 along the first direction $D_1$, by relative displacement of a band of film 4 and of the row 3 while applying the compression $C_1$ along the first direction $D_1$. Advantageously, the second film 4 extends from one end to the other of the rolls 1, covering the main faces 31, 33 and transverse faces 36, 38 of the row 3 and leaving the ends 12 and 14 of each roll free. The compression applied along the direction of the arrows $C_1$ is for example of the order of 1.5 tonnes. As seen in FIG. 3, following such a compression, the rolls 1 have a cross section of oval shape, the largest axis of which is along the second direction $D_2$ perpendicular to the longitudinal axes $X_1$ of the rolls and to the first direction $D_1$. By way of example, the module 5 has a length along the first direction $D_1$ of the order of 1100 to 1250 mm.

Preferably, the first film 2 and the second film 4 are each formed of a strip of plastic which is not very extensible, for example a strip of high-density polyethylene (HDPE), so that each film 2 and 4 maintains the rolls 1 of the row in their compressed state.

Figure 4:
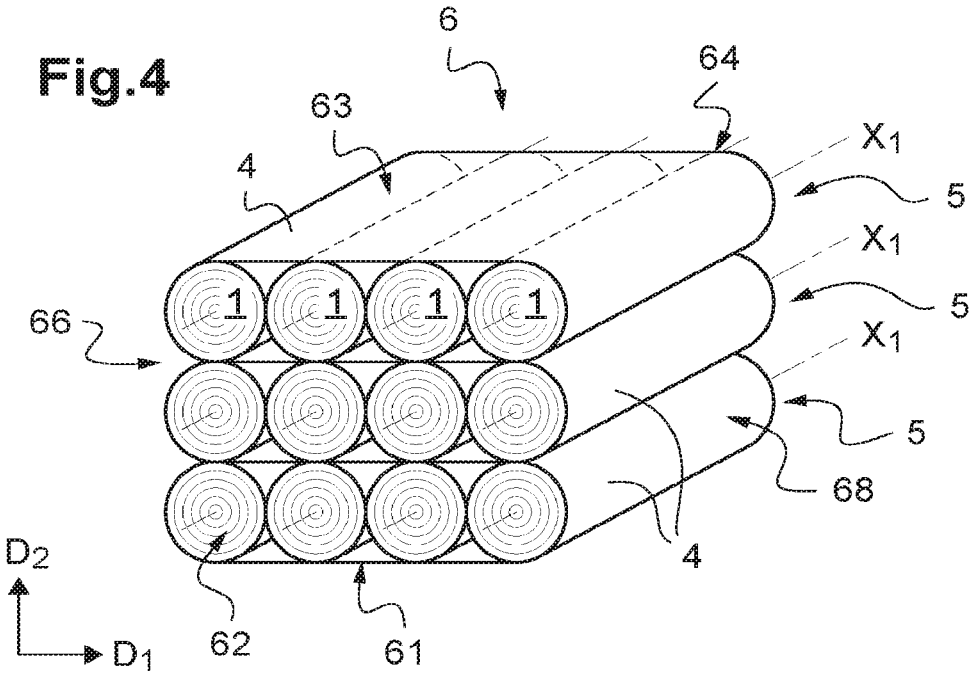

As shown in FIG. 4, several modules 5 are superimposed, along the second direction $D_2$ perpendicular to the longitudinal axes $X_1$ of the rolls and to the first direction $D_1$ of each module, so as to form a stack 6. The stack 6 comprises two end faces 62, 64, which are formed by the ends 12, 14 of the rolls 1, and main faces 61, 63 and transverse faces 66, 68, which are perpendicular to the end faces 62, 64. In the example represented, the stack 6 comprises three modules 5 superimposed along the second direction $D_2$.

Figure 5:
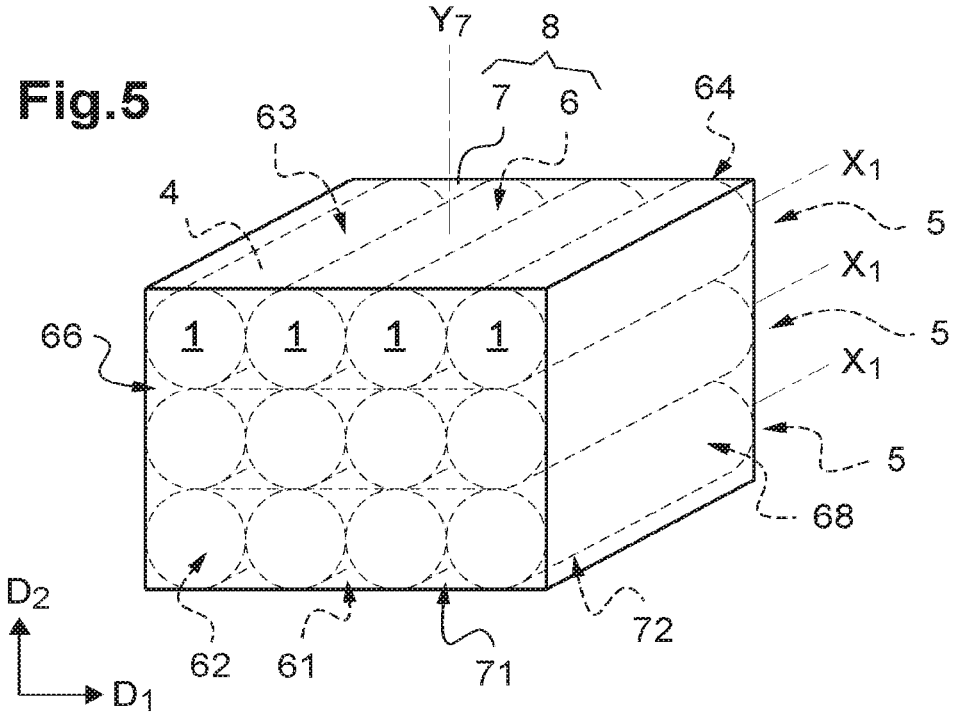

A pack 8 of rolls in accordance with the invention is obtained by wrapping the stack 6 of modules with a cover 7, so that the cover 7 covers five faces of the stack 6 including the two end faces 62, 64 and the cover 7 is folded over the periphery of the sixth face of the stack 6, which in the example from FIG. 5 is the lower main face 61 of the stack. Thus, one edge 72 of the cover 7 is positioned opposite the lower main face 61 of the stack 6 and covers the periphery of this face 61, while delimiting an opening 71 on this lower main face 61. The opening 71 is centered on an axis $Y_7$ perpendicular to the longitudinal axes $X_1$ of the rolls 1 of the stack 6.

Preferably, the cover 7 is a stretchable cover, formed from a sheath of stretchable plastic film, for example made of low-density polyethylene (LDPE). The wrapping of the stack 6 with the cover 7 is then carried out, in a known manner, in a stretchable cover packaging device. In FIG. 5, the vertical direction of the packaging device corresponds to the direction of the axis $Y_7$ of the cover 7. In this example, the cover 7 is deployed along the second direction $D_2$ around the stack 6.

Conventionally, in the packaging device, the sheath of stretchable plastic film is stored around a spool, by being pleated in a bellows or accordion tube shape. The packaging device comprises a welding station configured in order to weld the sheath forming a welded joint. After welding, the sheath is cut transversely in a cutting station in order to produce a cover 7 independent of the spool and sealed in its upper portion.

The pleated cover 7 is then stretched in a horizontal plane parallel to the welding zone of the upper portion of the cover 7, which is the plane perpendicular to the second direction $D_2$, while being positioned above the upper main face 63 of the stack 6. The cover 7 is then opened out, and deposited on and around the main face 63 and faces 62, 64, 66, 68 of the stack 6 following a vertical displacement from top to bottom along the second direction $D_2$.

At the end of the covering operation, the lower end of the cover 7 is folded under the lower main face 61 of the stack 6, for example with the aid of stretching clamps. The tightening of the cover 7 is then carried out by elasticity, which firmly holds the cover 7 around the stack 6 of modules. The edge 72 of the cover 7 positioned opposite the lower main face 61 then covers the periphery of this face 61, while delimiting the opening 71.

A pack 8 is then obtained that comprises twelve rolls, which is watertight since the package, formed by the combination of the cover 7 and the second film 4 of the end module closest to the opening 71, covers the whole of the six faces of the stack 6 of modules. The continuous overlap between the cover 7 and the second film 4 at the periphery of the main face 61 of the stack 6, where the second film 4 of the end module creates a flat and closed surface area, guarantees that there is no entry of water inside the pack 8. By way of example, the pack 8 has a length parallel to the axes $X_1$ of the rolls of the order of 800 to 1250 mm, a length along the first direction $D_1$ of the order of 1100 to 1250 mm, and a length along the second direction $D_2$ of the order of 1200 mm. Thus, it is possible to fit two pallets with dimensions of 1200 to 1250 mm by 1200 to 1250 mm, supporting superimposed packs 8, side-by-side in a truck having a width of the order of 2400 to 2500 mm. Of course, the dimensions of the rolls 1, the number of rolls 1 and the degree of compression $C_1$ may be adapted so that the dimensions of the packs 8 correspond to any conventional dimensions of pallets and of means of transport.

Using packs 8 of rolls in accordance with the invention as described above, it is possible to produce palletized assemblies in a simple manner. Two examples of palletized assemblies are illustrated in the first and second embodiments represented in FIGS. 6 to 9.

Figure 6:
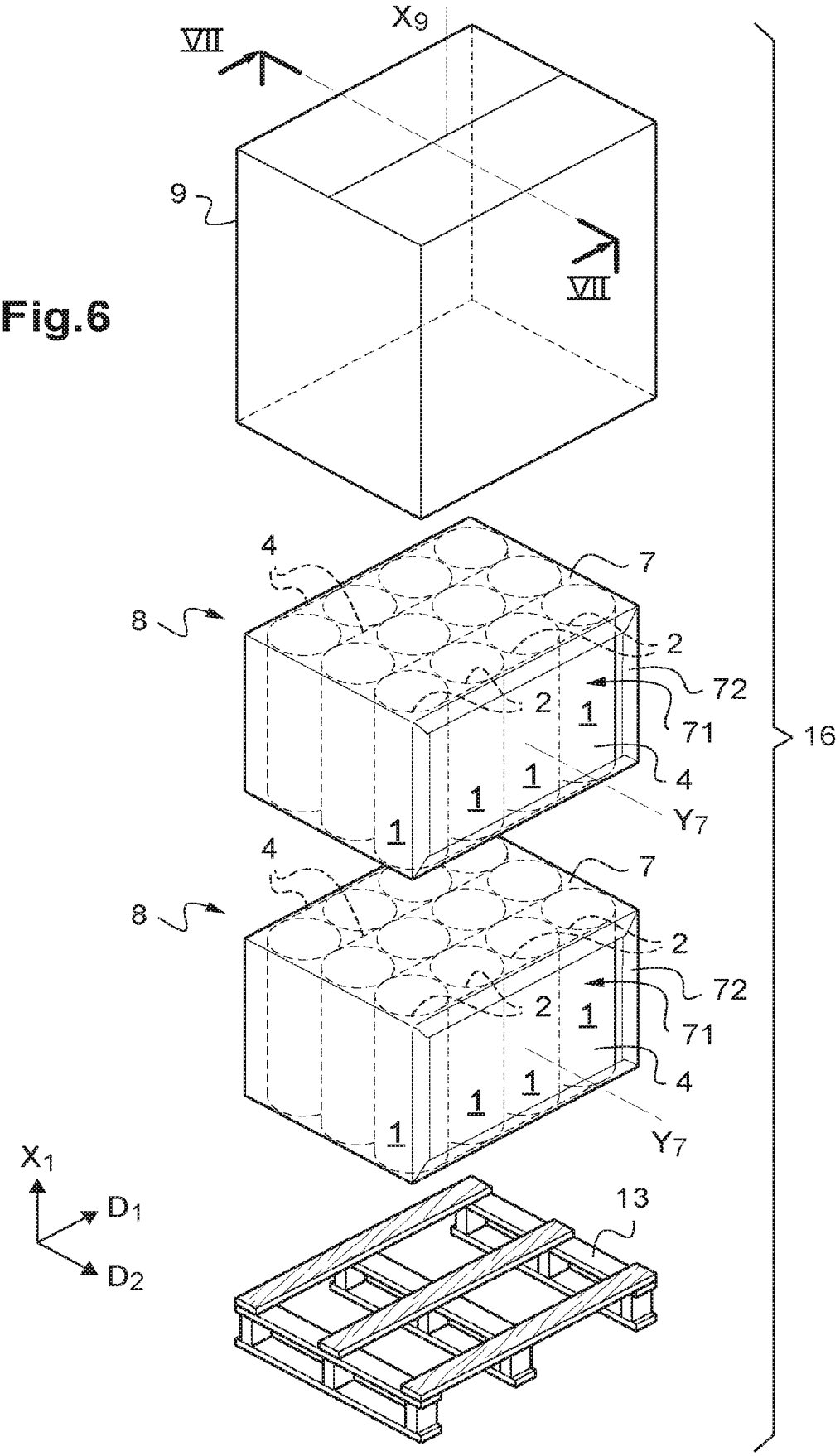
FIG. 6 is a schematic exploded perspective view of a first embodiment of a palletized assembly comprising two packs according to the invention.
Figure 7:
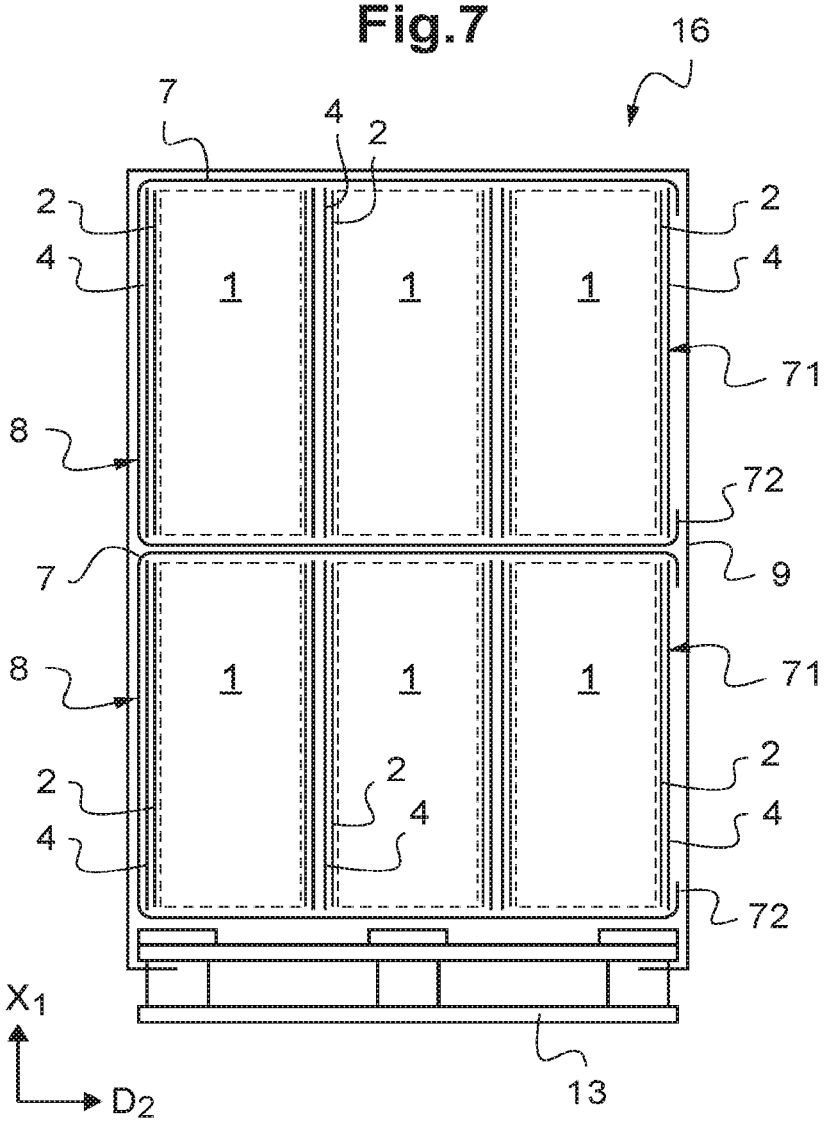
FIG. 7 is a schematic cross section along the plane VII from FIG. 6.

In the first embodiment represented in FIGS. 6 and 7, the palletized assembly 16 comprises a pallet 13 and two packs 8 of rolls. The pallet 13 is preferably formed of two wooden plates or duckboards spaced apart by spacers that define a sufficient space for the introduction of the forks of a handling appliance. Advantageously, the lower plate of the pallet 13 enables an easy displacement on a track and a stacking of loads. The two packs 8 are superimposed on one another and on the pallet 13 in a configuration where the rolls 1 are "upright" on the pallet 13, that is to say with their longitudinal axes $X_1$ perpendicular to the pallet. As clearly seen in FIG. 6, this corresponds to a configuration of each pack 8 pivoted by 90° relative to the configuration from FIG. 5. The opening 71 of the cover 7 of each pack 8 is then positioned laterally relative to the palletized assembly 16, each cover 7 possibly then being considered to be a "horizontal" cover in the palletized assembly 16.

For holding the packs 8 on the pallet 13, the palletized assembly 16 comprises an outer cover 9, which may be considered to be a "vertical" cover in the palletized assembly 16. Preferably, the outer cover 9 is a stretchable cover, formed by stretching a sheath of plastic film at the periphery of the packs 8. The installation of the outer cover 9 around the packs 8 and the pallet 13 is carried out, in a known manner, in a stretchable cover packaging device. In FIGS. 6 and 7, the vertical direction of the packaging device corresponds to the direction of the main axis $X_9$ of the outer cover 9. In this example, the outer cover 9 is deployed around the packs 8 and the pallet 13 along a direction parallel to the longitudinal axes $X_1$ of the rolls.

Advantageously, the device used for the installation of the "vertical" outer cover 9 around the packs 8 and the pallet 13 may be the same device as that used for the installation of the "horizontal" covers 7 on the stacks 6. In this case, the facility for manufacturing palletized assemblies may comprise means for 90° rotation of the packs 8 after the installation of their cover 7 and before the superposition thereof on the pallet 13.

The installation of the outer cover 9 around the packs 8 and the pallet 13 is carried out in a manner similar to that of the cover 7 around the stack 6. Thus, the depleted outer cover 9 is stretched in a horizontal plane parallel to the welding zone of the upper portion of the outer cover, which is the plane perpendicular to the longitudinal axes $X_1$ of the rolls. The outer cover 9 is then opened out, and deposited on and around the packs 8 and pallet 13 following a vertical displacement top to bottom along a direction parallel to the longitudinal axes $X_1$ of the rolls. At the end of the covering operation, the lower end of the outer cover 9 is folded under the pallet 13. The tightening of the outer cover 9 takes place by elasticity, which firmly holds the outer cover 9 around the load. The outer cover 9 protects the palletized assembly 16 from adverse weather conditions.

Figure 8:
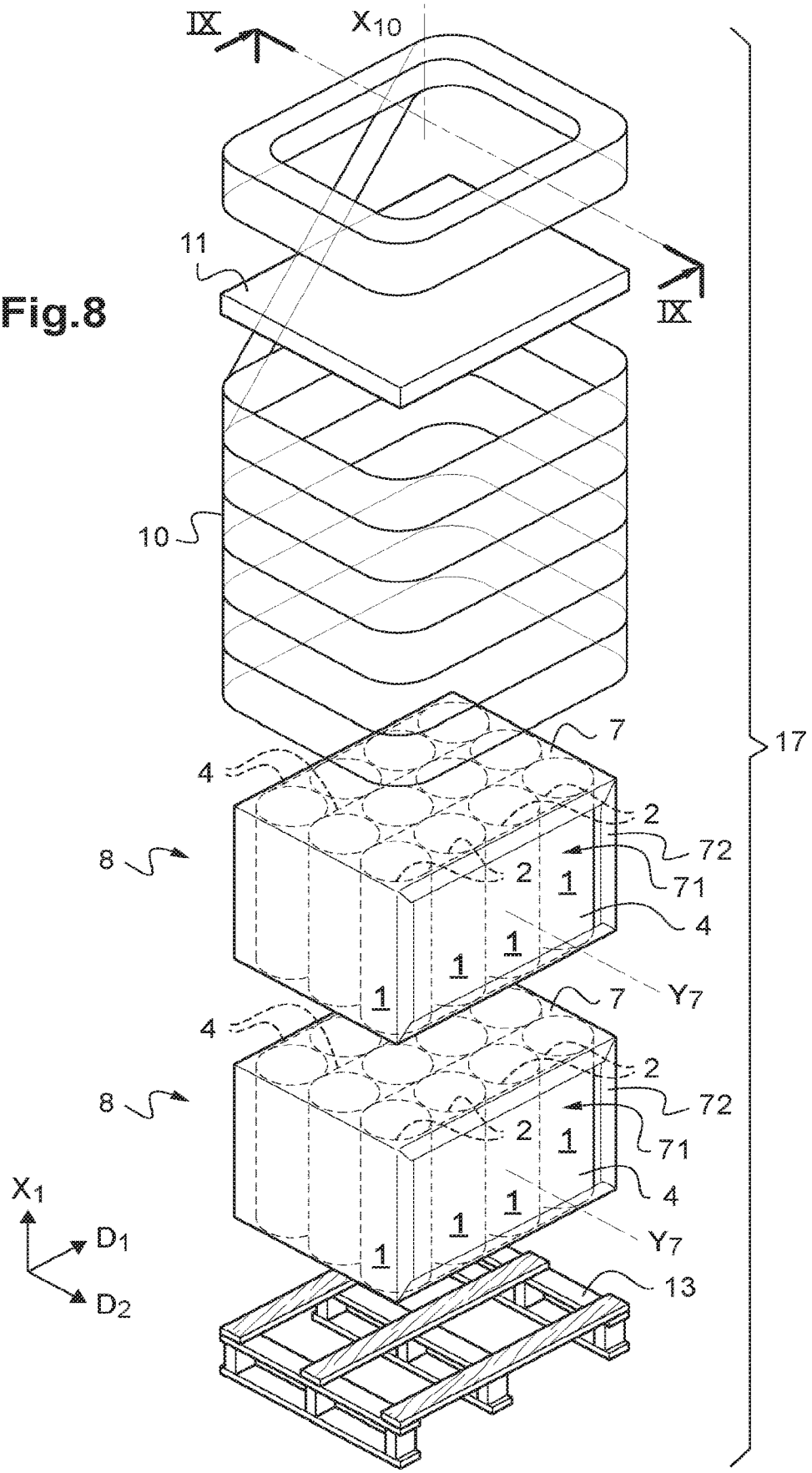
FIG. 8 is a view similar to FIG. 6 for a second embodiment of a palletized assembly comprising two packs according to the invention.
Figure 9:
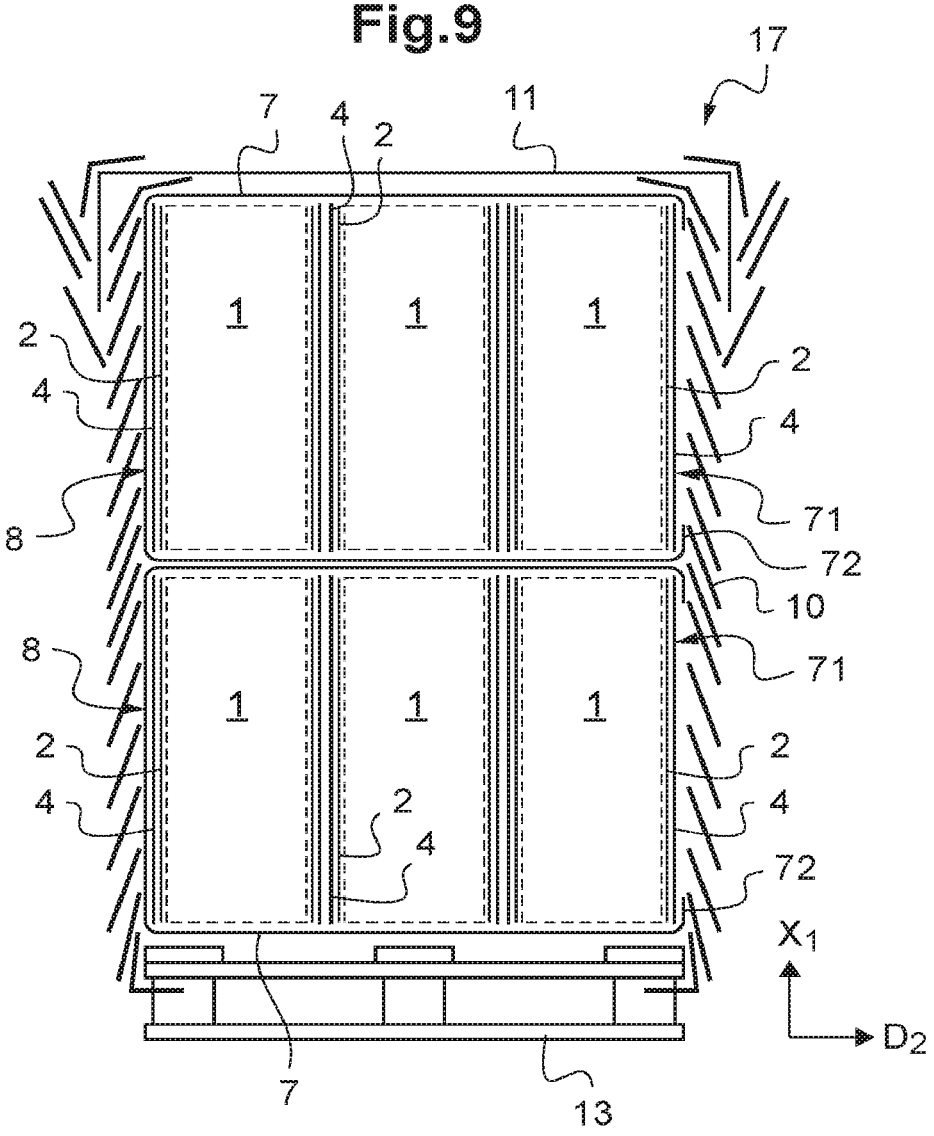
FIG. 9 is a schematic cross section along the plane IX from FIG. 8.

In the second embodiment of a palletized assembly represented in FIGS. 8 and 9, the elements similar to those of the first embodiment bear identical references. The palletized assembly 17 in accordance with the second embodiment differs from the first embodiment in that the packs 8 are not held on the pallet 13 using an outer cover 9, but by stretch wrapping using a film 10 which is deployed around the packs 8 and the pallet 13 with a displacement along a direction parallel to the longitudinal axes $X_1$ of the rolls.

The installation of the stretch-wrapping film 10 around the packs 8 and the pallet 13 is carried out, in a known manner, in a stretch-wrapping device. In FIGS. 8 and 9, the vertical direction of the stretch-wrapping device corresponds to the direction of the central axis $X_{10}$ of the stretch wrapping. The stretch-wrapping device may be, for example, a rotating ring machine, comprising a system of unwinding and stretching the stretch-wrapping film 10 and a system of installing a top sheet 11 on the top of the load. By way of example, the stretch-wrapping film 10 may be a polyethylene film with a thickness of 20 to 30 microns having a stretchability of 250%, and the top sheet 11 may be based on a relatively thick polyethylene film, having a thickness of at least 75 microns.

The stretch-wrapping operations take place in a manner suitable to protect the palletized assembly 17 from adverse weather conditions. For this purpose, the outermost layer of the stretch-wrapping film 10 is deployed from bottom to top, so that the layer positioned highest is always overlapping from the top, seen from the outside, with an arrangement similar to roof tiles, as represented schematically in FIG. 9. Such an arrangement prevents water from entering inside the palletized assembly 17. As is known, the number of turns and the percentages of overlap during the stretch wrapping are adjusted on a case-by-case basis.

For example, a stretch wrapping cycle is carried out in the following manner: when the assembly comprising the packs 8 positioned on the pallet 13 is in place in the stretch-wrapping device, a stabilizer plate is lowered to lock the load formed by the packs 8, and the stretch wrapping starts from the bottom, with a few turns that trap the pallet 13. Starting from the bottom, the ring is gradually moved up, a stop being made at the junction between the two packs 8 of the load. On approaching the top of the load, the stabilizer plate is withdrawn, which is possible since the load is self-stabilized by the film 10 already in place. A length of top sheet film 11 is then unwound, to the desired length on top of the load, the plate is lowered and the top sheet is cut. The stretch wrapping is then restarted downward over several turns, so that the top sheet 11 is encircled by several turns of the stretch-wrapping film 10, which is finally welded to itself and cut. In order to ensure protection against adverse weather conditions, any overlap between the turns of the film 10 that are stretch-wrapped downward around the top sheet 11 is avoided as much as possible.

The invention is not limited to the examples described and represented. In particular, the values given in the examples above for the dimensions of the rolls and packs are purely illustrative, it being understood that the dimensions of the packs according to the invention may be adapted, in particular in order to be compatible with any dimensions of pallets and of means of transport. Furthermore, the invention was described on the basis of examples using rolls as insulation products. As a variant, as mentioned previously, the invention is also applicable to other insulation products of elongated shape, such as batches of boards that are preassembled, having a substantially parallelepipedal shape. Furthermore, the invention may be implemented with film and cover materials that are different from those described above.

The invention claimed is:

1. A pack of compressible insulation products, each of the insulation products having a longitudinal axis, a peripheral surface, and first and second ends, the pack comprising:

a stack of at least two superimposed modules, where each of the modules comprises:

a row of the insulation products positioned next to one another, successively along a first direction perpendicular to the longitudinal axes of the insulation products, the insulation products of the row having their longitudinal axes parallel to one another, a first film which wraps each of the insulation products of the row in a compressed state of the insulation product by covering the peripheral surface of the insulation product, a second film which wraps the row of the insulation products, by covering some of the peripheral surface of the insulation products of the row, the at least two superposed modules of the stack being superimposed along a second direction perpendicular to the longitudinal axes of the insulation products and to the first direction of each module, the stack comprising two end faces formed by the ends of the insulation products and main faces and transverse faces that are perpendicular to the end faces; and a cover which wraps the stack of superimposed modules by covering five faces of the stack including the two end faces and at least a periphery of a sixth face of the stack.

2. The pack as claimed in claim 1, wherein the stack of modules is completely covered by the combination of the second film and the cover.

3. The pack as claimed in claim 1, wherein the second film forms, around the row of the insulation products, a sleeve having an axis parallel to the longitudinal axes of the insulation products.

4. The pack as claimed in claim 1, wherein the cover has a main axis perpendicular to the longitudinal axes of the insulation products.

5. The pack as claimed in claim 1, wherein the cover comprises an opening on the sixth face of the stack is perpendicular to the second direction.

6. The pack as claimed in claim 1, wherein the cover covers the sixth face of the stack.

7. The pack as claimed in claim 1, wherein the cover is a stretchable cover formed from a sheath of stretchable plastic film.

8. The pack as claimed in claim 1, wherein the second film is a plastic film having a tensile strength higher than that of a constituent plastic film of the cover.

9. The pack as claimed in claim 1, wherein the second film wraps the row of the insulation products in a compressed state of the insulation products against one another along the first direction.

10. A palletized assembly comprising:

a pallet, at least two of the packs as claimed in claim 1, which are superimposed on one another and on the pallet with the longitudinal axes of the insulation products perpendicular to the pallet, and means for holding the packs on the pallet.

11. The palletized assembly as claimed in claim 10, wherein the holding means comprise an outer cover formed by stretching a sheath of stretchable plastic film at a periphery of the packs.

12. The palletized assembly as claimed in claim 10, wherein the holding means comprise a film stretch-wrapped at a periphery of the packs.

13. A process for manufacturing a pack comprising compressible insulation products, each of the insulation products having a longitudinal axis, a peripheral surface, and first and second ends, the process comprising steps wherein:

wrapping each of the insulation products using a first film that covers the peripheral surface of the insulation product and which maintains the insulation product in a compressed state;

forming a row of the insulation products by positioning several insulation products provided with the first film next to one another, successively along a first direction perpendicular to the longitudinal axes of the insulation products, the insulation products of the row having their longitudinal axes parallel to one another;

forming a module by wrapping the row of the insulation products using a second film, which covers some of the peripheral surface of the insulation products of the row and which holds the insulation products of the row next to one another along the first direction;

forming a stack of the modules by superimposing at least two of the modules along a direction perpendicular to the longitudinal axes of the insulation products and to the first direction of each of the modules; and forming the pack by wrapping the stack of the modules using a cover which covers at least five faces of the stack including the two end faces of the stack formed by the ends of the insulation products.

14. A process for manufacturing a palletized assembly comprising compressible insulation products, each of the insulation products having a longitudinal axis, a peripheral surface, and first and second ends, the process comprising steps wherein:

wrapping each of the insulation products using a first film that covers the peripheral surface of the insulation product and which maintains the insulation product in a compressed state;

forming a row of the insulation products by positioning several of the insulation products provided with the first film next to one another, successively along a first direction perpendicular to the longitudinal axes of the insulation products, the insulation products of the row having their longitudinal axes parallel to one another;

forming a module by wrapping the row of the insulation products using a second film, which covers some of the peripheral surface of the insulation products of the row and which holds the insulation products of the row next to one another along the first direction;

forming a stack of the modules by superimposing at least two of the modules along a direction perpendicular to the longitudinal axes of the insulation products and to the first direction of each of the modules;

forming a pack by wrapping the stack of the modules using a cover which covers at least five faces of the stack including the two end faces of the stack formed by the ends of the insulation products;

superimposing at least two packs on one another and on a pallet with the longitudinal axes of the insulation products perpendicular to the pallet; and assembling the packs and the pallet using means for holding the packs on the pallet.

15. The process as claimed in claim 14, wherein the means for holding the packs include an outer cover or a stretch-wrapped film.

16. The process as claimed in claim 15, wherein the assembling the packs and the pallet includes stretching the outer cover in a plane parallel to the longitudinal axes of the insulation products and then displacing the outer cover in a direction parallel to the longitudinal axes of the insulation.

17. The process as claimed in claim 14, wherein the cover includes an opening on a sixth face of the stack.

18. The process as claimed in claim 13, wherein the cover includes an opening on a sixth face of the stack.

* * * * *